US007057482B2

(12) United States Patent
Helme et al.

(10) Patent No.: US 7,057,482 B2
(45) Date of Patent: Jun. 6, 2006

(54) ELECTROMAGNETIC FILTER ASSEMBLIES

(75) Inventors: Barry George Morton Helme, Liskeard (GB); Alan Twelves, Denbury (GB)

(73) Assignee: Quasar Microwave Technology Limited (GB)

( * ) Notice: Subject to any disclaimer, the term of this patent is extended or adjusted under 35 U.S.C. 154(b) by 27 days.

(21) Appl. No.: 10/502,725

(22) PCT Filed: Jan. 28, 2003

(86) PCT No.: PCT/GB03/00377

§ 371 (c)(1),
(2), (4) Date: Jul. 27, 2004

(87) PCT Pub. No.: WO03/065496

PCT Pub. Date: Aug. 7, 2003

(65) Prior Publication Data

US 2005/0073379 A1 Apr. 7, 2005

(30) Foreign Application Priority Data

Jan. 31, 2002 (GB) ..... 0202247.3

(51) Int. Cl.
*H01P 1/207* (2006.01)
*H01P 1/208* (2006.01)

(52) U.S. Cl. ..... 333/209; 333/212

(58) Field of Classification Search ..... 333/208–210, 333/212

See application file for complete search history.

(56) References Cited

U.S. PATENT DOCUMENTS 4,028,650 A * 6/1977 Konishi et al. ..... 333/210
4,800,349 A * 1/1989 Gurcan et al. ..... 333/208
6,392,508 B1 * 5/2002 Damphousse et al. ..... 333/209

* cited by examiner

*Primary Examiner*—Seungsook Ham
(74) *Attorney, Agent, or Firm*—Ira S. Dorman

(57) ABSTRACT

An electromagnetic filter assembly includes complimentary first and second blocks (1) and (2) defining two conjoined sections (10), (11) of an electromagnetic waveguide duct. A shim-like electromagnetic filter element (3) is held between the blocks and contains a series of holes (14) defining bridges (15) which traverse the waveguide duct to form poles of an electromagnetic filter. The filter element includes integral tuning projections (20) which extend into waveguide duct between the bridges. By adjusting the position of the filter element (3) between the blocks (1), (2) it is possible to vary the extent to which the tuning projections (20) project into the waveguide duct. The arrangement thus facilitates the repeated, continuous adjustment and variation of the electrical characteristics of devices such as filters, diplexers and multiplexers.

5 Claims, 3 Drawing Sheets

ELECTROMAGNETIC FILTER ASSEMBLIES

TECHNICAL FIELD OF THE INVENTION

This invention relates to electromagnetic filter assemblies such as are used in filters, diplexers and multiplexers. More particularly, the invention relates to the tuning of such filters.

BACKGROUND

Filters, diplexers, multiplexers and other devices which incorporate an electromagnetic filter assembly disposed in an electromagnetic waveguide may be manufactured in the form of two blocks or plates with half of the waveguide duct machined in each plate and one or more a thin metal sheets or shims with appropriate cut-outs sandwiched between the plates. The cut-outs in the or each shim are produced in such a way that when the parts are assembled, the cut-outs form a series of thin metal bridges which traverse the waveguide duct. The axial thickness and spacing of the bridges, and the number of bridges, determine the frequency characteristics of the filter.

The current known art of tuning waveguides is to use screws which penetrate into the waveguide duct, positioned along the centre line of the waveguide. This achieves minimum insertion loss and maximum tuning effect. However, such an arrangement is not practical with metal shim filters since the tuning screws must be clear of the shim, and placing the screws clear of the shim increases the insertion loss of the filter. Furthermore, in devices which incorporate two or more filter assemblies use of tuning screws may require the tuning of each filter cavity and thus has the disadvantage of requiring skilled operators to carry out the task, which may be time consuming.

Another known way of tuning such devices is to form dents in the walls of the waveguide duct, but this has the disadvantage of being time consuming, difficult to achieve and irreversible.

The present invention seeks to provide a new and inventive form of tuning method for such devices, which does not involve any of the above methods and is inexpensive, fast, simple to achieve and manufacture, repeatable, low loss and reversible.

SUMMARY OF THE INVENTION

The present invention proposes an electromagnetic filter assembly which includes complimentary first and second blocks defining two conjoined sections of an electromagnetic waveguide duct, and a shim-like electromagnetic filter element which is held between the blocks and contains a series of holes which define bridges which traverse the waveguide duct to form poles of an electromagnetic filter, characterised in that the filter element includes integral tuning projections which extend into waveguide duct between the bridges.

By adjusting the position of the filter element between the blocks it is possible to vary the extent to which the tuning projections project into the waveguide duct. The arrangement thus facilitates the repeated, continuous adjustment and variation of the electrical characteristics of devices such as filters, diplexers and multiplexers.

BRIEF DESCRIPTION OF THE DRAWINGS

The following description and the accompanying drawings referred to therein are included by way of non-limiting example in order to illustrate how the invention may be put into practice. In the drawings.

DETAILED DESCRIPTION OF THE DRAWINGS

The drawings show an electromagnetic waveguide filter assembly of the kind which may be used in various devices such as filters, diplexers and multiplexers.

Figure 1:
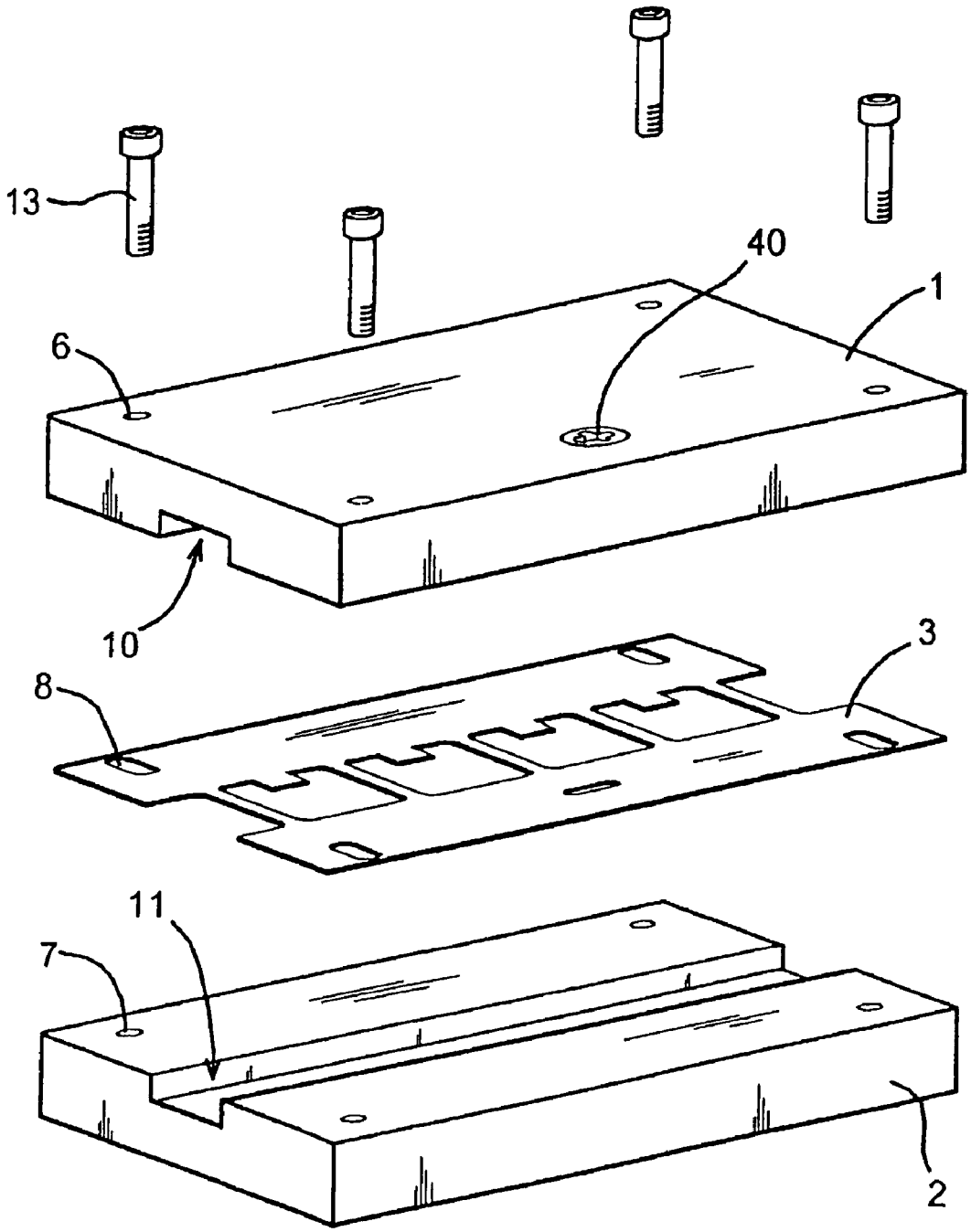
FIG. 1 is a general exploded view of an electromagnetic filter assembly in accordance with the invention.
Figure 2:
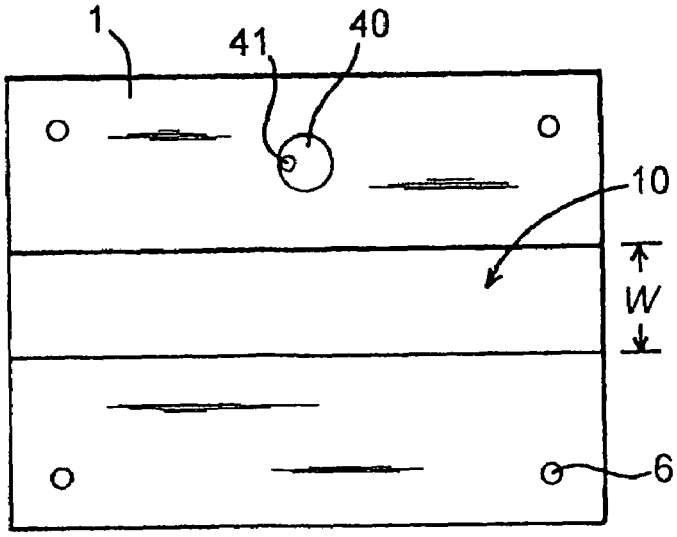
FIG. 2 shows the three main components of the assembly, each in plan view.
Figure 2:
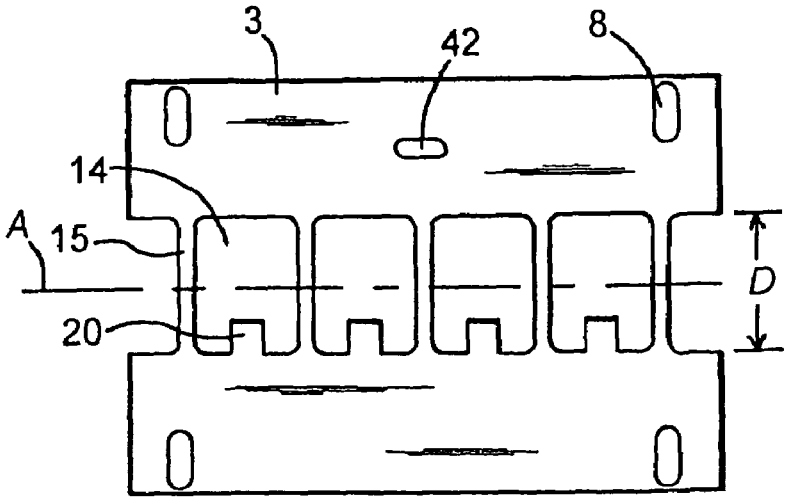
Figure 2:
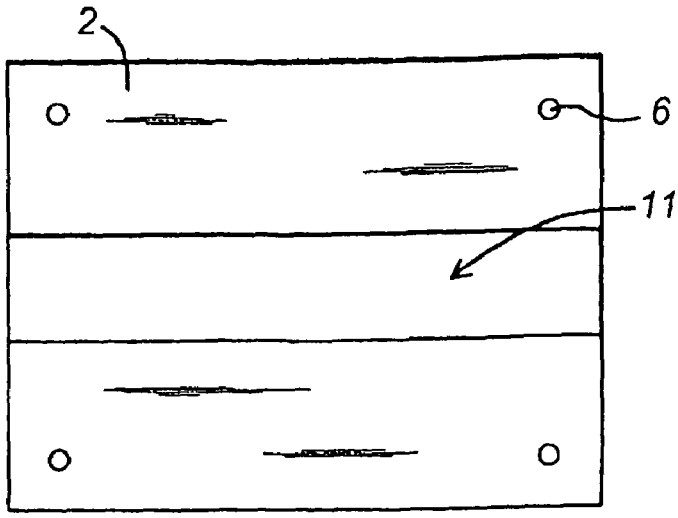

FIG. 1 shows the main components of the assembly, namely complimentary first and second blocks 1, 2 and a shim-like electromagnetic filter element 3. As can also be seen in FIG. 2, the blocks 1 and 2 are formed of metal and contain two complimentary machined channels 10 and 11 which, when the blocks are brought together, become conjoined to form an electromagnetic waveguide duct. In this example the duct is of substantially rectangular cross-section although those skilled in the art will appreciate that the duct can be of any other appropriate shape such as round, oval, elliptical etc. The shim 3 is held between the blocks, which may be connected together by any suitable means such as bolts, clamps etc. By way of example, screws 13 may pass through holes 6 in the first block 1 to engage in threaded apertures 7 in the second block 2. The shim 3 is provided with corresponding slots 8 to receive the screws 5, extending transverse to the waveguide duct.

The shim 3 is formed from a conductive metal foil and contains a row of rectangular holes 14 which form the poles of an electromagnetic filter and which define a series of foil bridges 15. When the blocks 1 and 2 are brought together as in FIG. 1 the filter element 3 is held between the blocks with the holes 14 disposed in the waveguide duct such that the bridges 15 extend transversely across the duct. It will be noted in FIG. 2 that the dimension D of the holes 14, which extends transverse to the axis A of the waveguide, is greater than the transverse width W of the waveguide. One longitudinal edge of each hole 14 is provided with an integral foil projection 20 (shown as a rectangular tab) which is disposed mid-way between adjacent bridges 15.

Figure 3:
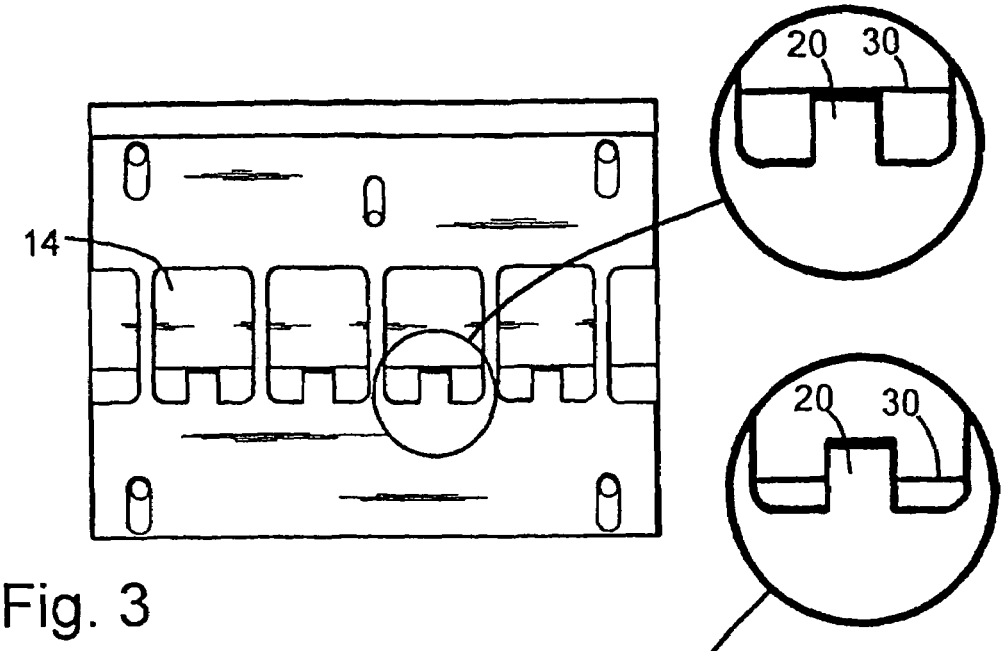
FIGS. 3 to 5 each show the components partly assembled in three different adjustment conditions.
Figure 4:
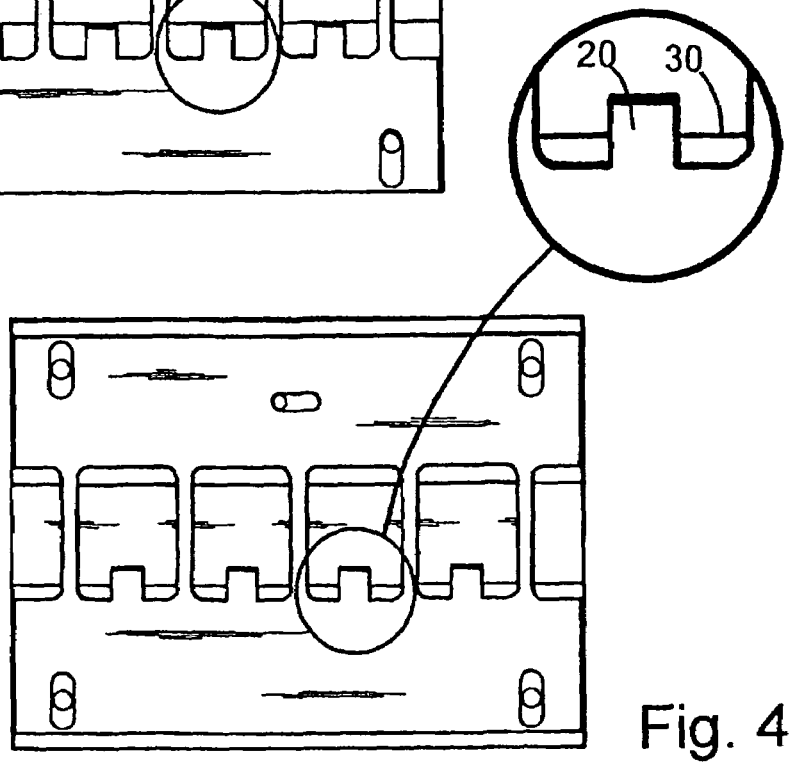
Figure 5:
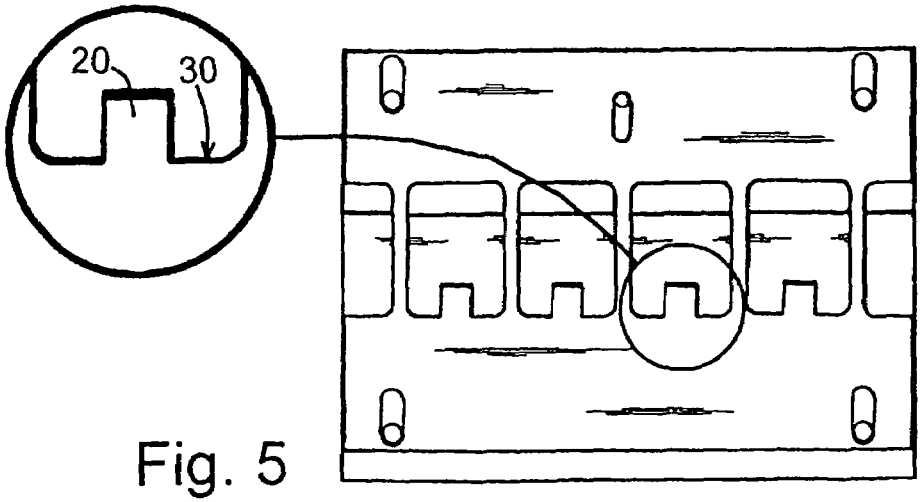

By adjusting the transverse position of the filter element 3 between the blocks 1 and 2 it is possible to vary the extent to which the tuning tabs 20 project into the waveguide duct. Thus, at one end of the tuning range, shown in FIG. 3, the tabs 20 may be completely withdrawn between the blocks 1 and 2 so that they do not project beyond the opposed edges 30 of the waveguide duct. In the mid tuning range the tabs project part-way into the duct as shown in FIG. 4, and at the other end of the tuning range the tabs extend fully into the duct as shown in FIG. 5. The arrangement thus allows continuous adjustment and variation of the electrical characteristics of the filter.

The movement of the shim may be achieved by one or more posts 40 (FIG. 2) which are rotatably mounted in either of the blocks 1, 2 with eccentric fingers 41 located in slots 42 in the shim 3 extending parallel to the waveguide duct. The tuning may, but not exclusively, be achieved in the following manner. Screws 13 holding the top and bottom plates together are loosened sufficiently to just allow the shim to slide. The tuning post (or posts) are turned to slide the shim transverse to the duct and tune the filter to the required specification. The screws holding the top and bottom plates together are then tightened to the required torque. Small adjustments to the tuning can be made by repeating the above steps. When completed the fixing screws and shim adjusting post(s) may be fixed in place by a suitable means, e.g. glue etc.

It will be appreciated that the features disclosed herein may be present in any feasible combination. Whilst the above description lays emphasis on those areas which, in combination, are believed to be new, protection is claimed for any inventive combination of the features disclosed herein.

The invention claimed is:

1. An electromagnetic filter assembly which includes complimentary first and second blocks (1, 2) defining two conjoined sections (10, 11) of an electromagnetic waveguide duct, and a shim-like electromagnetic filter element (3) which is held between the blocks and contains a series of holes (14) which define bridges (15) which traverse the waveguide duct to form poles of an electromagnetic filter, characterised in that the filter element includes integral tuning projections (20) which extend into the waveguide duct between the bridges; and in that said duct has a longitudinal axis and said holes have a transverse dimension, transverse to said longitudinal axis, which is greater than the corresponding transverse width of the waveguide duct.

2. An electromagnetic filter assembly in accordance with claim 1 wherein said transverse dimension of said holes is such that said tuning projections can be completely withdrawn from said waveguide duct.

3. An electromagnetic filter assembly in accordance with claim 1 wherein said tuning projections are disposed substantially mid-way between adjacent bridges.

4. An electromagnetic filter assembly in accordance with claim 1 wherein said holes are substantially rectangular.

5. An electromagnetic filter assembly in accordance with claim 1 wherein said tuning projections are substantially rectangular.

* * * * *

UNITED STATES PATENT AND TRADEMARK OFFICE

CERTIFICATE OF CORRECTION

PATENT NO. : 7,057,482 B2
APPLICATION NO. : 10/502725
DATED : June 6, 2006
INVENTOR(S) : Barry George Morton Helme and Alan Twelves It is certified that error appears in the above-identified patent and that said Letters Patent is hereby corrected as shown below:

At item 73 on the title page, delete "Quasar Microwave Technology Limited (GB)" and substitute -- Andrew Limited (GB) --.

Signed and Sealed this

Eleventh Day of September, 2007

JON W. DUDAS
*Director of the United States Patent and Trademark Office*